US005480769A

United States Patent [19]

Ueffinger et al.

[11] Patent Number: 5,480,769

[45] Date of Patent: Jan. 2, 1996

[54] METHOD AND APPARATUS FOR CONTROLLING ELECTROLYTIC SILVER RECOVERY FOR TWO FILM PROCESSING MACHINES

[75] Inventors: Gerhard Ueffinger, Weinstadt-Grossheppach; Franz Huettemeister, Leinfelden-Echterdingen, both of Germany

[73] Assignee: Eastman Kodak Company, Rochester, N.Y.

[21] Appl. No.: 239,080

[22] Filed: May 6, 1994

[30] Foreign Application Priority Data

May 8, 1993 [DE] Germany ..... 43 15 433.6

[51] Int. Cl.[6] ..... G03C 5/38; G03C 5/395; C25C 1/20

[52] U.S. Cl. ..... 430/401; 430/398; 430/400; 204/109; 204/229

[58] Field of Search ..... 430/398, 400, 430/401; 204/109, 229, 275, 237; 205/263

[56] References Cited

U.S. PATENT DOCUMENTS 4,362,608 12/1982 Biles et al. ..... 204/109

FOREIGN PATENT DOCUMENTS 1188822 3/1979 Germany .

OTHER PUBLICATIONS

Brochure of the Company H. Stamm KG/1991.

*Primary Examiner*—Charles L. Bowers, Jr.
*Assistant Examiner*—Mark F. Huff
*Attorney, Agent, or Firm*—John R. Everett

[57] ABSTRACT

The invention relates to a method and apparatus for controlling electrolytic silver recovery for two film processing machines which enables the fixing baths to be connected with a silver recovery unit according to their level of silver concentration. According to the invention, the silver concentration in a fixing bath having a liquid connection with the silver recovery unit and in an unconnected fixing bath is continually calculated by electronic means and a control signal is generated when the difference in silver concentration between the connected and the unconnected fixing baths reaches a pre-definable level, said control signal causing actuators to connect the silver recovery unit with the fixing bath having the higher concentration of silver. When the silver concentration reaches a pre-definable level an electrolysing current in the silver recovery unit is switched on and remains switched on until the silver concentration falls below the pre-defined level.

2 Claims, 1 Drawing Sheet

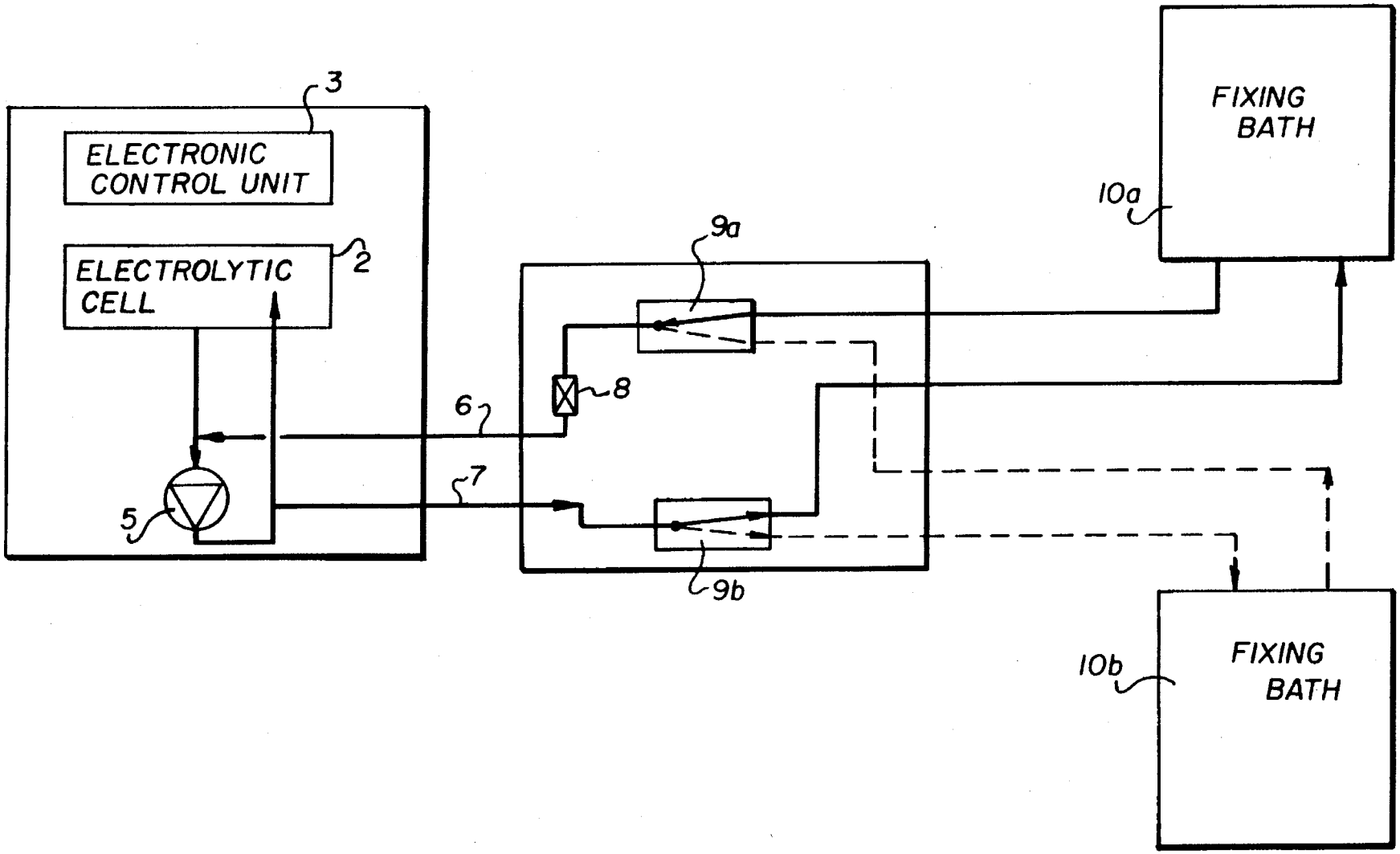
FIXING BATH
10a
FIXING BATH
10b
9a
9b
8
6
7
3
ELECTRONIC CONTROL UNIT
2
ELECTROLYTIC CELL
5

METHOD AND APPARATUS FOR CONTROLLING ELECTROLYTIC SILVER RECOVERY FOR TWO FILM PROCESSING MACHINES

FIELD OF THE INVENTION

The invention relates to a method and apparatus for controlling electrolytic silver recovery for two film processing machines whereby the silver concentration is determined with the aid of the photosensitive surfaces which pass through the treatment baths of the film processing machines and used as the basis for connecting the fixing baths with a silver recovery unit.

BACKGROUND OF THE INVENTION

Methods of this type, in which a processing machine transmits a signal which is proportional to the developed area of film and therefore also to the amount of silver passed into the fixing bath, are well known.

With regard to electrolytic silver recovery for a film processing machine, it is known from DE-PS 1 188 822 that the level of recovery is controlled by switching the electrolysing current on and off according to the quantity of the photographic material passing through the fixing bath.

On-line fixing bath regeneration systems for one to three processing machines, in which the fixing bath fluids are continuously fed via connecting pipes into an electrolytic silver extraction unit, where the silver is removed, and then fed back into the fixing baths, are known. (Brochure of the company H. Stamm KG/1991). The electrolysing current is controlled in the familiar manner by signals which are proportional to the silver concentration level of the fluid mixture formed in the recovery unit which is either measured by sensors placed at that point or determined on the basis of the area of film passing through the fixing baths.

The "Ecosys F 08" on-line apparatus for two processing machines produced by the company AgfaGevaert AG performs fixing bath regeneration in a similar manner.

The disadvantage of these methods is the fact that silver extraction for each individual fixing bath is not performed on the basis of the amount of silver passing into the fixing bath, which is relative to the area of film passed through each bath. Optimum silver extraction of each separate fixing bath according to its silver concentration level at any one time is therefore not possible.

Another disadvantage lies in the fact that if the amount of silver passing into each fixing bath varies significantly, a fixing solution mixture is formed in the silver recovery unit whose overall silver concentration is lower than the concentration in the fixing bath with the higher film throughput. Since equal electrolysing currents will achieve higher silver recovery rates with higher silver concentrations than with lower concentrations, rapid recovery of silver from the fixing solution is not possible with this type of method.

SUMMARY OF THE INVENTION

The object of the invention is to provide a method and a apparatus for electrolytic silver recovery for two film processing machines which enables the fixing baths to be linked with a silver recovery unit as required by the silver concentration level using the minimum of equipment as well as allowing minimization of silver extraction losses.

According to the invention, the above object is attained in that the silver concentration levels in a fixing bath having a liquid connection with the silver recovery unit and in an unconnected fixing bath are continually calculated by electronic means, and in that when a pre-definable difference in silver concentration between the connected and unconnected fixing baths is reached, a control signal is generated which causes actuators to connect the silver recovery unit with the fixing bath having the higher silver concentration level, the electrolysing current being switched on when the silver concentration level reaches a pre-definable level and remaining switched on until the said concentration level falls below the said pre-defined level.

If, for a pre-definable period, the silver concentration remains below the level required to switch on the electrolysing current and the pre-defined difference in silver concentration between the fixing baths remains below the pre-defined level, the silver recovery unit is connected alternately with each fixing bath for a pre-definable period in order to counteract chemical breakdown of the fixing solution caused by long periods of inactivity.

The method requires an outflow and a return pipe forming the liquid connection between each of the fixing baths and the silver recovery unit and a valve arrangement which according to the invention takes the form of a valve controllable by electronic means in each of the outflow and return pipes for selective connection of one of the fixing baths with the silver recovery unit.

BRIEF DESCRIPTION OF THE DRAWING

The invention is shown in more detail in the only diagram, which is a schematic representation of the apparatus for performing the method according to the invention.

DETAILS OF THE INVENTION

The silver recovery unit contains an electrolytic cell 2, an electronic control unit 3 and a circulation pump 5. The liquid connection between the fixing baths 10*a* and 10*b* of two film processing machines (not illustrated) and the electrolytic cell 2 is formed by an outflow pipe 6 leading to the electrolytic cell 2 and a return pipe 7 leading from the electrolytic cell 2, said outflow and return pipes being fitted with controllable valves 9*a* and 9*b* for turning the flow of liquid on and off. A flow meter 8 is fitted in the outflow pipe 6 in order to monitor the flow of liquid between the electrolytic cell 2 and the fixing bath connected to it 10*a* or 10*b*, said flow being effected by the circulation pump 5.

Not shown in the diagram are the electrical connections required for the control unit 3 to control the valves 9*a* and 9*b* and for carrying the signals transmitted by the two film processing machines, said signals being proportional to the amount of silver passing into the fixing baths.

It is obvious that the method can be performed not only using two 3/2 valves as shown in the diagram, but also using four 2/2 valves.

The method according to the invention can be described as follows:

With the circulation pump 5 switched on, the fixing baths 10*a* and 10*b* and the electrolytic cell 2 initially contain fixing solution which is free of silver, while the electrolytic cell 2 in the silver recovery unit 1 is connected to one of the fixing baths 10*a* for example by virtue of the valves 9*a* and 9*b* being set to the appropriate position. If a film is then passed through the said fixing bath, the film processing machine belonging to that fixing bath transmits a signal to the control unit 3 via electrical wiring not illustrated. The control unit determines the area of film which corresponds to that signal and calculates the amount of silver passing into the fixing bath 10*a* on the basis of a programmed average figure. The overall silver concentration of the system connected with the fixing bath is continually calculated on the basis of the known volumes of the fixing bath, the electrolytic cell 2 and the pipes 6 and 7.

At the same time, films can be passed through the fixing bath 10*b* that is not connected with the electrolytic cell 2 in the silver recovery unit 1. In the same way as described above, the control unit 3 calculates the amount of silver passing into the fixing bath and the resulting silver concentration for fixing bath 10*a* on its own.

If the difference between the silver concentration in the fixing bath 10*a* connected with the silver recovery unit 1 and in the fixing bath 10*b* not connected with the silver recovery unit 1 reaches a level pre-determined on the control unit 3 of, say, 0.1 g of silver/l, so that as a result of processing a different amount of film the higher concentration of silver is present in fixing bath 10*b*, the control unit 3 generates a signal which switches over the valves 9*a* and 9*b* so as to connect fixing bath 10*b* with the silver recovery unit 1. The silver concentration of fixing bath 10*a* is continually recalculated and stored in accordance with the subsequent progress of film processing and therefore the amount of silver passing into the fixing bath.

After switch-over of the system, the control unit 3 calculates the new overall silver concentration on the basis of the known silver concentrations of the electrolytic cell 2 and the fixing bath 10*b*, said overall silver concentration being continually recalculated and stored on the basis of film subsequently processed and the resulting amount of silver passing into fixing bath 10*b*.

If the difference in silver concentration again reaches 0.1 g of silver/l, with the higher concentration of silver now being present in fixing bath 10*a*, the valves 9*a* and 9*b* are switched over again so that fixing bath 10*a* is connected with the silver recovery unit, the new silver concentration level being once again calculated and stored in the familiar manner.

If the silver concentration in one of the systems consisting either of electrolytic cell 2 and fixing bath 10*a* or electrolytic cell 2 and fixing bath 10*b* reaches a level similarly predetermined on the control unit of, say, 0.25 g of silver/l, an electrolysing current is switched on. The fixing bath concerned is then connected with the electrolytic cell 2.

If the silver concentration level in the system consisting of the electrolytic cell 2 and the connected fixing bath 10*a* for example is greater than 0.25 g/l and if the calculated difference between that and the concentration level in the system consisting of the electrolytic cell 2 and fixing bath 10*b* exceeds the predetermined level of, say, +0.1 g/l, then fixing bath 10*b* is automatically connected with the silver recovery unit.

The electrolysing current remains switched on until the calculated concentration level for each of the two systems drops to 0.25 g/l or lower.

If the silver concentration in either of the two fixing baths 10*a* and 10*b*, one of which is connected to the electrolytic cell 2 and one of which is not, does not reach the predetermined level of 0.25 g of silver/l, and if the difference in silver concentration levels between the two fixing baths does not reach 0.1 g of silver/l within a certain period predetermined on the control unit 3 of, say 5 minutes, the electrolytic cell 2 is connected alternately with each of the fixing baths 10*a* and 10*b* for a predetermined period of, say 15 minutes.

This system thus not only controls the connection of the fixing baths with the silver recovery unit dependent on the silver concentration level but also ensures, in the event of long periods of inactivity as a result of small amounts of silver passing into the fixing baths, that the temperature of the fixing solution is maintained throughout the system by circulation.

We claim:

1. A method for controlling electrolytic recovery of silver for two film-processing machines each having a fixing bath wherein one of the fixing baths is fluidly connected with a silver recovery unit; the method comprises the steps of:

a) calculating a silver concentration in each fixing bath on the basis of an area of photo-sensitive material passing through each fixing bath;

b) comparing silver concentrations according to the calculation of step a) with a predetermined silver concentration stored in an electronic control unit;

c) calculating any difference between silver concentrations of the fixing baths and comparing the calculated difference with a predetermined difference;

d) maintaining the fluid connection with the silver recovery unit and the fluidly connected fixing bath if the calculated silver concentration difference is greater than the predetermined difference; or switching the fluid connection with the silver recovery unit to the other fixing bath if the calculated silver concentration difference is smaller than the predetermined difference, and e) switching on electrolytic current when the silver concentration equals or is greater than the predetermined silver concentration until the silver concentration falls below the predetermined concentration; and (f) repeating steps (a) through (e) continuously.

2. A method for controlling electrolytic recovery of silver for two film-processing machines each having a fixing bath wherein one of the fixing baths is fluidly connected with a silver recovery unit; the method comprises the steps of:

a) calculating the silver concentration in each fixing bath on the basis of an area of photo-sensitive material passing through each fixing bath;

b) comparing silver concentrations according to the calculation of step a) with a predetermined silver concentration stored in an electronic control unit;

c) calculating any difference between the silver concentrations of the fixing baths and comparing the calculated difference with a predetermined difference; and (d) alternatively connecting the silver recovery unit with each fixing bath for a predetermined time if, for a predetermined time interval, the silver concentration remains below the predetermined silver concentration or the calculated silver concentration difference between the fixing baths remains below the predetermined difference.

* * * * *